US011563261B2

(12) United States Patent
Dinh et al.

(10) Patent No.: US 11,563,261 B2
(45) Date of Patent: Jan. 24, 2023

(54) FOUR-PORT DIRECTIONAL COUPLER HAVING A MAIN LINE AND TWO SECONDARY LINES, WHERE THE TWO SECONDARY LINES ARE COUPLED TO COMPENSATION CIRCUITS WITH ATTENUATION REGULATOR CIRCUITS

(71) Applicant: VIETTEL GROUP, Ha Noi (VN)

(72) Inventors: Cong Kien Dinh, Ha Noi (VN); Hoang Linh Nguyen, Ha Noi (VN); Tien Manh Nguyen, Ha Noi (VN); Duc Phu Phung, Ha Noi (VN); Ba Dat Nguyen, Ha Noi (VN)

(73) Assignee: VIETTEL GROUP, Ha Noi (VN)

( * ) Notice: Subject to any disclaimer, the term of this patent is extended or adjusted under 35 U.S.C. 154(b) by 101 days.

(21) Appl. No.: 17/138,023

(22) Filed: Dec. 30, 2020

(65) Prior Publication Data

US 2021/0273309 A1 Sep. 2, 2021

(30) Foreign Application Priority Data

Feb. 28, 2020 (VN) ..... 1-2020-01153

(51) Int. Cl.
*H01P 5/18* (2006.01)
*H01P 3/08* (2006.01)

(52) U.S. Cl.
CPC ..... *H01P 5/184* (2013.01); *H01P 3/081* (2013.01); *H01P 5/18* (2013.01)

(58) Field of Classification Search
CPC ..... H01P 5/18; H01P 5/184
USPC ..... 333/116
See application file for complete search history.

(56) References Cited

U.S. PATENT DOCUMENTS

| | | | | |
|---|---|---|---|---|
| 9,184,483 | B2 * | 11/2015 | Zeller et al. | H01P 5/185 |
| 2013/0141184 | A1 * | 6/2013 | Tamaru et al. | H01P 5/185 333/112 |
| 2018/0102582 | A1 * | 4/2018 | Tanaka | H01P 5/184 |

* cited by examiner

*Primary Examiner* — Benny T Lee
(74) *Attorney, Agent, or Firm* — patenttm.us

(57) ABSTRACT

The invention proposes a four-port coupler using micro-strip line in combination with ultra-wide-band compensation circuits. It can be applied for communication systems or information machine systems. The main feature of the invention is the structure and the distribution of the components in the compensation circuit to reduce the size of the coupler. The proposed coupler includes: microstrip directional coupler and compensation circuits, in which the microstrip directional coupler consists of one main line and two secondary transmission lines; the main transmission line has two ports: input and output ports; each secondary is connected to a load and a compensation circuit. The compensation circuit is composed of a low-pass filter and two parallel attenuation regulator circuits.

4 Claims, 3 Drawing Sheets

FOUR-PORT DIRECTIONAL COUPLER HAVING A MAIN LINE AND TWO SECONDARY LINES, WHERE THE TWO SECONDARY LINES ARE COUPLED TO COMPENSATION CIRCUITS WITH ATTENUATION REGULATOR CIRCUITS

FIELD OF THE INVENTION

The invention refers to microstrip ultra-wide-band couplers. The design includes compensation circuits to produce flat coupling factor and high directivity on an ultra-wide frequency range. The coupler is employed to extract power on active transmission lines.

DESCRIPTION OF THE RELATED ART

A coupler is a passive element with the function of arbitrary proportional power division, used in high frequency systems.

A coupler is typically a four-port network where the first port is the input port, the second port is the output port, the third port is the coupled port, and the fourth port is the isolated port. The relationship between the ports is described using the following scattering matrix:

$$[S] = \begin{bmatrix} S_{11} & S_{12} & S_{13} & S_{14} \\ S_{21} & S_{22} & S_{23} & S_{24} \\ S_{31} & S_{32} & S_{33} & S_{34} \\ S_{41} & S_{42} & S_{43} & S_{44} \end{bmatrix} \tag{a}$$

A specific element of the scattering matrix can be determined as $$S_{ij} = \left.\frac{V_i^-}{V_j^+}\right|_{V_k^+=0 \ for \ k\neq j}. \tag{b}$$

In words, (b) says that $S_{ij}$ is found by driving port j with an incident wave of voltage $V_j^+$ and measuring the reflected wave amplitude $V_i^+$ coming out of port i.

Typical coupler specifications include:

The isolation I is calculated as the ratio of the input power $P_1$ at input port 1 and output power $P_4$ at isolated port 4:

$$I = 10\log_{10}\frac{P_1}{P_4} = -20\log_{10}|S_{14}| \tag{c}$$

The directivity D is calculated by the ratio of the output power $P_3$ at coupled port 3 to the output power $P_4$ at isolated port 4:

$$D = 10\log_{10}\frac{P_3}{P_4} \tag{d}$$

The insertion loss L is calculated as the ratio of output power $P_2$ at output 2 to input power $P_1$ at input port 1:

$$L = 10\log_{10}\frac{P_1}{P_2} = -20\log_{10}|S_{12}| \tag{e}$$

The return loss RL at the ports characteristic the impedance matching at the ports is determined as:

$$RL=-20\log_{10}|\Gamma_i|=-20\log_{10}|S_{ii}| \tag{f}$$

Where $S_{ii}$ is the reflection coefficient seen looking into port i when all other ports are terminated in matched loads.

Where $P_1$ is the input power at the input port 1; $P_2$, $P_3$ and $P_4$ are the output power at output port 2, coupled port 3 and isolated port 4, respectively; $\Gamma_i$ (i from 1 to 4) is the reflection coefficient at input port 1, output port 2, coupled port 3 and isolated port 4.

The coupler is commonly realized by the following structures:

Waveguide directional coupler: the structure of this coupler consists of two waveguides that are closely coupled, and connected to each other by one or more holes in the junction wall. The bandwidth of single-hole couplers is narrower than that of multi-hole couplers which are bulky in size as designed for low bands.

Directional couplers employ either microstrip or and stripline structure: the majority of couplers are performed on a microstrip or stripline structure due to their simplicity and ease of design. Similar to waveguide directional couplers, at the low operating bands, the size of the coupler is very large.

Lange coupler: is composed of four parallel lines designed so that the coupler has a coupling factor of 3 dB or 6 dB. This coupler has a 90° phase difference between the output port 2 and the coupled port 3, the Lange coupler is thus a form of a 90° hybrid coupler. This structure can he only applied for the requirement of small coupling factor and the phase difference between the two output ports of 90°.

Couplers usually use passive components: this coupler is designed with passive components such as resistors, capacitors and inductors. The values of the components are calculated to obtain the required coupling factor. Couplers with passive electronics are only applicable for low operating frequency range.

In order to overcome the above limitations, in this invention, the inventors propose a coupler derived from the directional coupler structure. By combining a microstrip structure with a compensation circuit made of passive components, a coupler operating over super wide band frequency range is achieved.

SUMMARY OF THE INVENTION

The purpose of the present invention is to introduce a four-port coupler that can operate over a super wide frequency band. By combining the microstrip directional coupler with compensation circuits made of passive components, the size of the coupler is considerably reduced.

The coupler is applied to measure power in high power transmitters operating in the HF, VHF and UHF band.

In order to satisfy the ultra-wideband requirement, from HF to UHF band, the microstrip directional coupler and compensator circuits using passive electronic components are employed together. Thus, the operating frequency range is widened while the coupler size for low frequencies is maintained small. Due to the proposal method, the following quality criteria are achieved:

Operating band: 20-500 MHz;

Characteristic impedance at input port 1 and output port 2: 50Ω;

Coupling factor C=56 dB, insertion loss L<0.1 dB, isolation factor I>70 dB, directivity D>15 dB.

The invention presents the detail structure of the proposed coupler including: microstrip-line part; microstrip directional coupler structure; the coupling structure and the information of the integrated passive components.

DETAILED DESCRIPTION OF THE INVENTION

Figure 1:
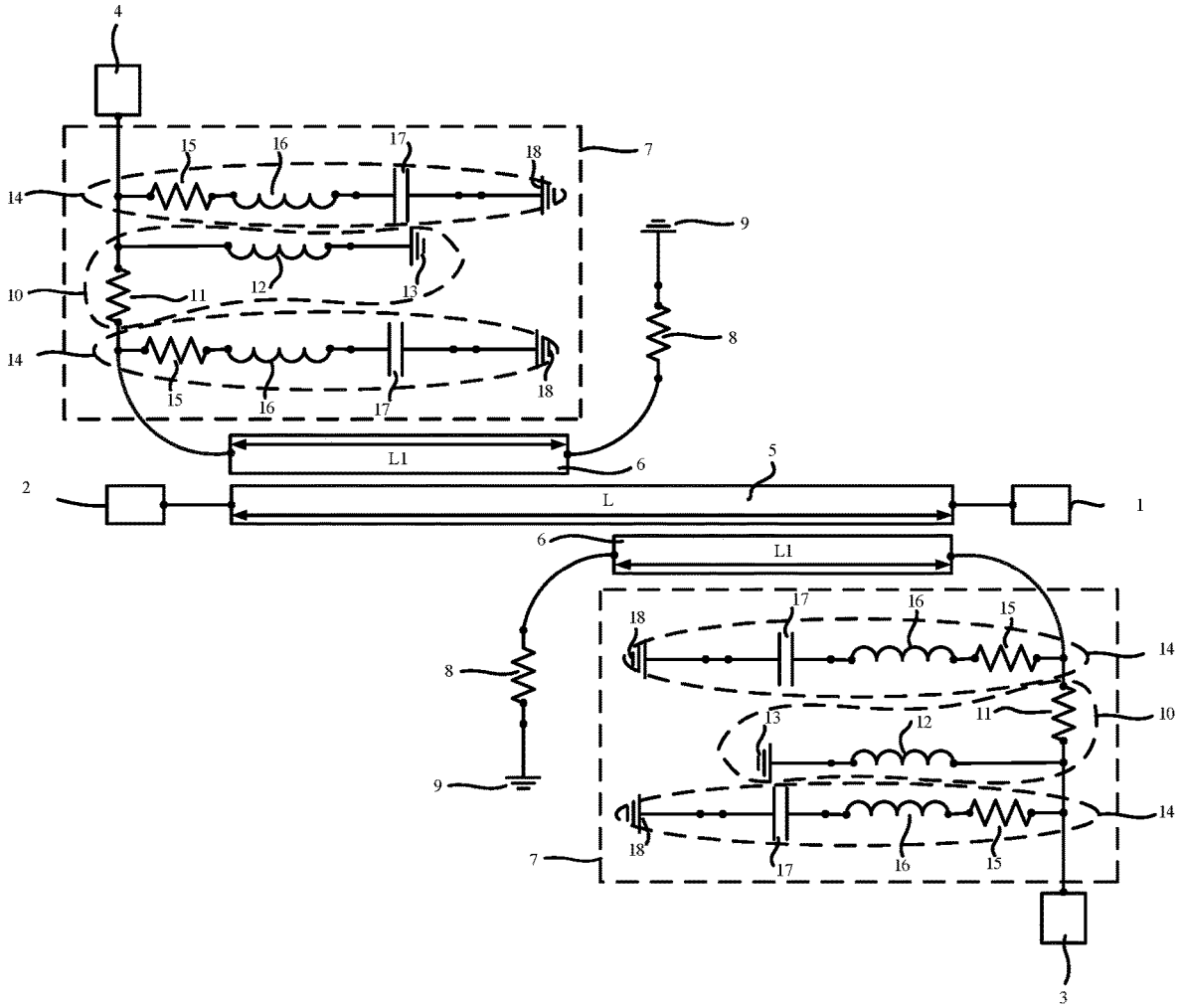
FIG. 1 shows the structure of the ultra-wide band coupler.

As shown in FIG. 1, the proposed ultra-wide-band coupler includes the following components: input port 1, output port 2, coupled port 3, isolating port 4; main transmission line 5, secondary transmission line 6 and compensation circuit 7.

The center part of the directional coupler is the main transmission line 5 with the length L, the characteristic impedance of 50Ω, connecting the input port 1 and output port 2. The input signals start at port 1 and come out at port 2 after an extraction.

Two secondary transmission lines 6 with the characteristic impedance of 50Ω and the length $L_1$ are electrically coupled with the main transmission line 5 at the opposite terminals. Each secondary transmission line is connected to a load and a compensation circuit 7.

Each secondary transmission 6 is connected to a load 8 before going to ground 9 at one end and to a compensation circuit 7 at the other end.

Compensation circuit 7 is composed of a low pass filter 10 and two attenuation regulator circuits 14 that are installed in parallel. The first attenuation regulator circuit is placed between the output port of the secondary transmission line 6 and the low-pass filter 10 while the second regulator circuit is installed between the low-pass filter 10 and the coupled port 3 or the isolating port 4.

The low pass filter 10 including resistor 11 and inductor 12 is designed with the cutoff frequency coinciding with the minimum frequency of the coupler and the loss coefficient in the stop band is frequency proportional to the coupling factor between the main transmission line 5 and secondary transmission line 6.

The attenuation regulator circuit 14 including resistor 15, inductor 16, capacitor 17 and ground terminal 18 compensates the coupling factor between the input port 1 and the coupled port 3.

Without the compensation circuit, the coupling factor goes up as the frequency increases. On the other hand, the attenuation of the low pass filter circuit 10 at the stopband increases as the frequency increases. Since the coupler includes a low pass filter 10, signals from the input port 1 to the coupled port 3 will be reduced due to the attenuation characteristic at the stopband of the low-pass filter 10. The combination of the coupling factor and the filter attenuation will flatten the coupling factor line. To further flatten the coupling factor line, an attenuation regulator circuit is introduced. In general, due to the compensation circuit, the coupling factor line is flat over the operating frequency range of the coupler.

Since the attenuation coefficient in the stopband of the low-pass filter is relatively large, only one low-pass filter is employed. For the attenuation regulator circuit, there are many sub-bands of the operating frequency range of the coupler in which the coupling factor is not flat. Thus the larger number of attenuation regulator circuits will make the coupling factor line flatter. However, a large number of attenuation tuning circuits is not suitable due to the increased size of the coupler. In this invention, the inventors have found that the optimum number of attenuation regulator circuits for a coupler is two.

After entering the port 1, due to electromagnetic induction, the signal appears on the secondary transmission line 6. The ratio between the signal power of the coupled port 3 and that of the input port 1 represents the coupling factor C of the two lines, and is defined as:

$$C = 10\log_{10}\frac{P_1}{P_3} \tag{b}$$

The compensation circuit 7 is employed to ensure the stable coupling factor over the operating frequency range. Additionally, the compensation circuit 7 also increases the isolation factor between the input port 1 and the isolating port 4.

If the directional coupler in FIG. 1 is an ideally reversed coupler, the signal from the input 1 is induced, appearing at the coupled port 3 and there is no signal at the isolating port 4. Under the such conditions, the directivity D will become infinite.

If the directional coupler does not have a compensating circuit, the directivity of the directional coupler is much poorer. This phenomenon results from the induction between the main transmission line 5 and the secondary transmission line 6 and the value of the directivity D for the microstrip coupler is typically between 7 and 13 dB, depending on the operating frequency. In this invention, the coupler uses a compensating circuit to reduce the induction from the main transmission line 5 to the secondary link 6, thereby improving the D directivity of the entire structure. In addition, the compensation circuit can reduce the effective electrical length of the microstrip line. The results of the invention show that it is possible to shorten the length of the main transmission line from λ0/4 to λ0/30 and the secondary transmission line from λ0/8 to λ0/120 (λ0 is the wavelength of the center frequency of the bandwidth).

Execution Example

Figure 2:
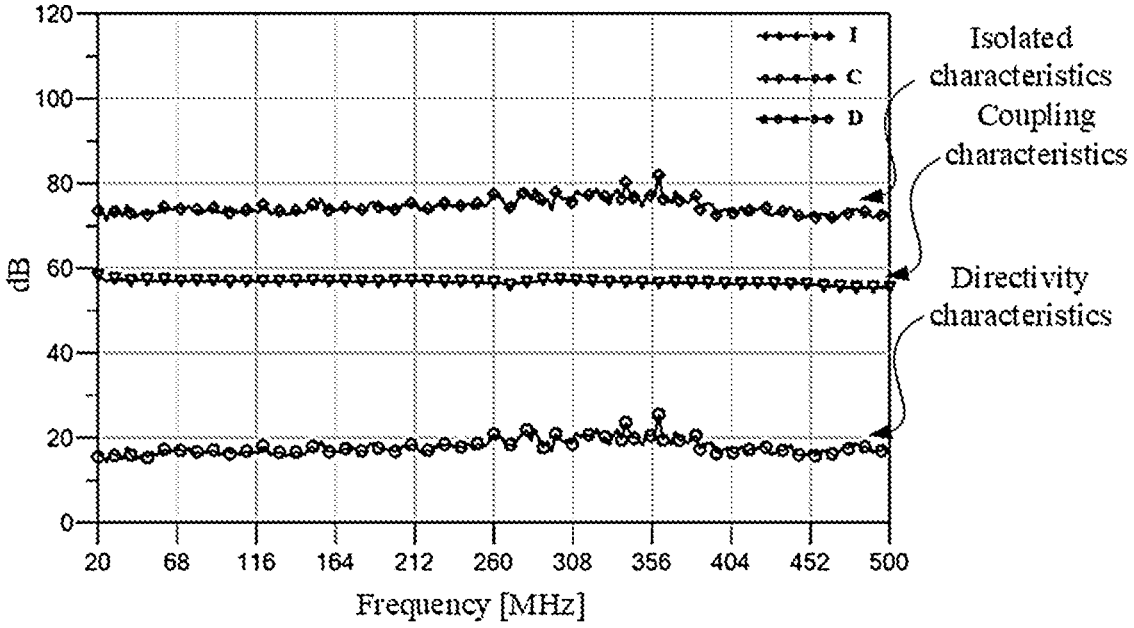
FIG. 2 shows the measurement results of the isolation factor I, the coupling factor C and the directivity D.
Figure 3:
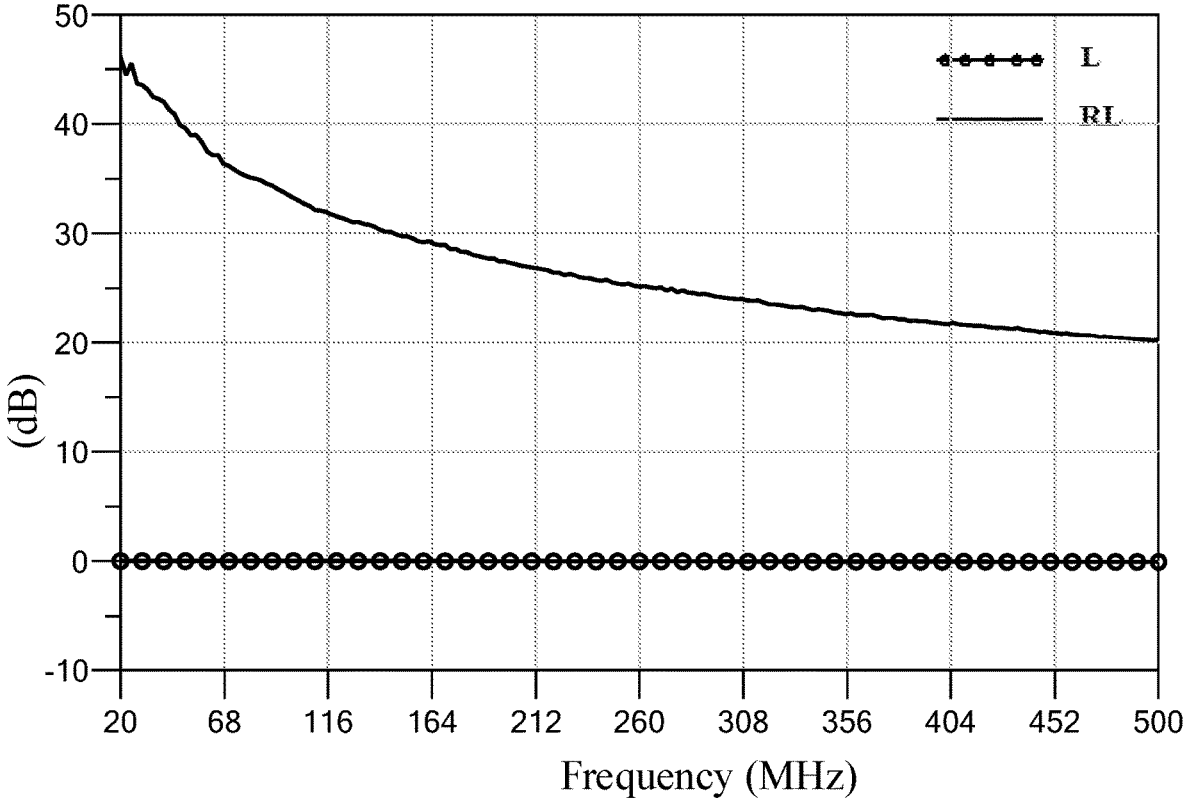
FIG. 3 shows the measurement results of the attenuation coefficient L and the return loss RL at the input port of the coupler.

This invention proposes the coupler applied for measuring power in an ultra-wide frequency range including HF, VHF and UHF bands. FIGS. 2 and 3 show coupler test results for the frequency range from 20 to 500 MHz. The coupling factor C (FIG. 2) is approximately 56 dB with a deviation of ±1 dB over the frequency range. The attenuation coefficient L (FIG. 3) smaller than 0.1 represents the nearly conserved output power on the main line 5. The required isolation factor I (FIG. 2) is greater than 70 dB, the directional factor D (FIG. 2) also meets the requirement that the directional factor D is higher than 15 dB. The return loss RL (FIG. 3) of the input port 1 and the output port 2 are greater than 20 dB showing that the coupler ports are well impedance matched.

In particular, the invention can also be applied for many other cases such as HF-VHF band, VHF-UHF band or exclusively for each one of the three bands. For higher frequency bands such as L-band, S-band, this invention is also applicable to reduce the size of the coupler.

What is claimed is:

1. A four-port coupler with a microstrip line in combination with an ultra-wide-band compensation circuit, including microstrip directional couplers and compensation circuits, of which:

the microstrip directional coupler consists of a main and two secondary transmission lines; the main line has an input port and an output port; each secondary line has one port connected to the respective compensation circuit and another port terminated by a resistor; each secondary transmission line is electrically coupled with the main line;

each compensation circuit comprises a respectively low-pass filter and corresponding first and second attenuation regulator circuits which are parallel to each other; the corresponding first attenuation regulator circuit is connected between the respective one of the two secondary lines and the respectively low-pass filter, the corresponding second attenuation regulator circuit is placed between the respectively low-pass filter and a coupling port or an isolating port of the respective secondary line.

2. The four-port coupler with a microstrip structure in combination with an ultra-wide-band compensation circuit according to claim 1, in which: the low-pass filter includes resistors and inductors that provides a cut-off frequency equal to a minimum operating frequency of the four-port coupler; wherein as frequency increases up, a loss factor in a frequency stop band is proportional to a coupling factor between the main and the two secondary transmission lines.

3. The four-port coupler with a microstrip structure in combination with an ultra-wide-band compensation circuit according to claim 2 in which: each attenuation regulator circuit is composed of resistors, inductors and capacitors.

4. The four-port coupler with a microstrip structure in combination with an ultra-wide-band compensation circuit according to claim 1 in which: at least one of the attenuation regulator circuits is composed of resistors, inductors and capacitors.

* * * * *